United States Patent [19]

Asanuma et al.

[11] Patent Number: 4,955,316

[45] Date of Patent: Sep. 11, 1990

[54] DEVELOPING DEVICE

[75] Inventors: Masato Asanuma; Masatoshi Kaneshige; Toyoka Aimoto, all of Nara, Japan

[73] Assignee: Sharp Kabushiki Kaisha, Osaka, Japan

[21] Appl. No.: 382,868

[22] Filed: Jul. 20, 1989

[30] Foreign Application Priority Data

Aug. 8, 1988 [JP] Japan ..... 63-198526
Aug. 8, 1988 [JP] Japan ..... 63-198527

[51] Int. Cl.[5] ..... G03G 15/09

[52] U.S. Cl. ..... 118/657; 355/253; 355/260; 222/DIG. 1

[58] Field of Search ..... 355/251, 253, 245, 260; 118/656–658; 222/DIG. 1

[56] References Cited

U.S. PATENT DOCUMENTS

| | | | |
|---|---|---|---|
| 4,351,604 | 9/1982 | Karasawa et al. | 355/251 X |
| 4,592,653 | 6/1986 | Ikeda et al. | 355/253 |
| 4,699,079 | 10/1987 | Palm et al. | 355/253 X |
| 4,786,936 | 11/1988 | Ikegawa et al. | 355/253 |
| 4,800,412 | 1/1989 | Ueda | 355/251 |

*Primary Examiner*—R. L. Moses

*Attorney, Agent, or Firm*—Flehr, Hohbach, Test, Albritton & Herbert

[57] ABSTRACT

A developing device comprising: a developing magnet roller for feeding developer onto a photoreceptor; a shutter mechanism for switching from feeding developer to the developing magnet roller to suspending the above supply, or vice versa; a delivery magnet roller for receiving developer from the developing magnet roller and conveying it to a path leading to the shutter mechanism; a toner feed path for interconnecting a toner hopper disposed at the upper end of a main body of the developing device and the space above the shutter mechanism. In order to prevent toner from escaping through a gap formed between the toner hopper and its lid, the developing device is designed to have an interconnecting path for interconnecting the space in the vicinity of the toner feed path within the main body and a different space within the main body, or to have, within the toner hopper, a guide member for guiding air that has come into the toner hopper from the main body through the toner feed path, so as to avoid a gap between the toner hopper and its lid, thereby preventing toner from scattering outside the developing device through the above gap.

11 Claims, 4 Drawing Sheets

DEVELOPING DEVICE

FIELD OF THE INVENTION

The present invention relates to a developing device for supplying toner onto a photoreceptor, used in an electrostatic copying device, laser printer or other image forming apparatus.

BACKGROUND OF THE INVENTION

One known form of developing device installed in an image forming apparatus such as an electrostatic copying apparatus comprises a shutter mechanism 24 in the interior of a main body 21 of the developing device as shown in FIG. 3. The shutter mechanism 24 is designed such that the operation thereof can be switched thereby to feed developer 22 stored in the main body 21 to a developing magnet roller 23 or to suspend the supply mentioned above. At the upper end of the main body 21 is disposed a toner hopper 28 comprising a toner feed roller 30 therein, and the space underneath the toner feed roller 30 is interconnected with the space above the shutter mechanism 24 thereby forming a toner feed path 31.

In the aforementioned developing device, the shutter mechanism 24 is open at the time of performing development as shown in FIG. 3, and the developer 22 which has been fed through the shutter mechanism 24 is adhered to the peripheral surface of a rotative sleeve 23*a* of the developing magnet roller 23 thereby forming a magnetic brush. The magnetic brush formed by the toner component of the developer 22 is brought in contact with and rubbed against the surface of a photoreceptor belt 25 and thereby toner is continuously supplied onto the photoreceptor belt 25.

During the time in which development is not performed, the shutter mechanism 24 is closed as shown in FIG. 4, whereby the supply of the developer 22 to the developing magnet roller 23 is suspended. Even during this time period, the rotative sleeve 23*a* of the developing magnet roller 23 and a rotative sleeve 26*a* of a delivery magnet roller 26 disposed above the developing magnet roller 23 are continuously rotating, and the developer 22 is conveyed accordingly into the space above the shutter mechanism 24 and gradually accumulates localizing in the space which extends from the delivery magnet roller 26 to the shutter mechanism 24. The developer 22, which has been conveyed by the delivery magnet roller 26 during the time in which development is not performed as shown in FIG. 4, accumulates in the space which extends from the delivery magnet roller 26 to the shutter mechanism 24, resulting in forming a heap above the delivery magnet roller 26 and coming in contact with the upper wall portion of the main body 21. This heap of developer 22 confines the air in the space in the vicinity of the toner feed path 31 within the main body 21.

Thereafter, the remaining developer 22 around the developing magnet roller 23 is conveyed upward by the developing magnet roller 23, causing the developer 22 which has been conveyed by the delivery magnet roller 26 to press the heap of developer 22 above mentioned. Then, the air confined in the above space is gradually compressed developing a relatively high pressure. Loosing a way of escape within the main body 21, the air thus compressed flows all at once into the toner hopper 28 from the inside of the main body 21 through the toner feed path 31, as indicated by the arrow X of FIG. 4.

When the air comes into the toner hopper 28, toner stored within the toner hopper 28 is blown off by the air. This tends to cause air including a great amount of toner to go out through a gap between the toner hopper 28 and its lid 28*a* as indicated by the arrow Y of FIG. 4 and to scatter outward. The toner which has been out and scattered from the toner hopper 28 then adheres to a corona charger, members in an optical system and other members disposed in the copying apparatus or the like, resulting in considerable deterioration of the image quality.

In order to overcome the above problem, such a method can be adopted that the air which has been compressed in the main body 21 is positively released outside the developing device while a filter or the like is attached to the outlet of the air for preventing the discharge of toner. However, this method requires periodic replacement of the filter or the like bringing about another problem such as a considerable increase in the maintenance cost.

SUMMARY OF THE INVENTION

An object of the present invention is to provide a developing device capable of preventing toner stored in a toner hopper from going out, when no development is performed, through a gap which is liable to be formed between the toner hopper and its lid, and scattering outside the developing device.

Another object of the present invention is to provide a developing device capable of preventing the generation of compressed air in the vicinity of a toner feed path within a main body of the developing device, thereby preventing the escape and scattering of toner through the gap between the toner hopper and its lid.

Another object of the present invention is to provide a developing device capable of preventing the escape and scattering of toner through the gap between the toner hopper and its lid even if the compressed air comes into the toner hopper from the main body of the developing device through the toner feed path.

A further object of the present invention is to provide a developing device capable of preventing the escape and scattering of toner through the gap between the toner hopper and its lid thereby preventing deterioration of the image quality caused by adhesion of toner to a corona charger, members in an optical system and other members, in the case the above developing device is provided within a copying device for example.

In order to achieve the foregoing objects, a developing device according to the present invention comprises, within a main body thereof, a developing magnet roller for feeding developer onto a photoreceptor; a shutter mechanism for switching from feeding developer to the developing magnet roller to suspending the above supply, or vice versa; and a delivery magnet roller for receiving developer from the developing magnet roller and conveying it to a path leading to the shutter mechanism, said developing device further comprising a toner feed path for interconnecting a toner hopper disposed at the upper end of the main body of the developing device and the space above the shutter mechanism; and an interconnecting path for interconnecting the space in the vicinity of the toner feed path within the main body and a different space, existing within the main body.

The above interconnecting path may be disposed inside the main body of the developing device so as to interconnect the space in the vicinity of the toner path and a different space, or disposed outside the main body in the form of a pipe thereby interconnecting the space in the vicinity of the toner feed path and a different space.

The above different space within the main body of the developing device to be interconnected with the space in the vicinity of the toner feed path may be, for instance, the space in the vicinity of the lower part of the delivery magnet roller located above the developing magnet roller, or may be the space surrounded by the shutter mechanism and the developing magnet roller.

The above interconnecting path may be constituted by the wall portions of the main body of the developing device and path forming members disposed along the wall portions, leaving a predetermined spacing therebetween.

In the developing device of the above arrangement, even if the air in the space in the vicinity of the toner feed path within the main body is compressed by the heap of developer, this compressed air will not flow into the toner hopper through the toner feed path but will be guided through the interconnecting path into a different space which exists within the main body, said different space being a space differed from the space in the vicinity of the toner feed path and having a relatively low air-pressure. More specifically, the compressed air in the space near the toner feed path is released and the air thus released is admitted into another low-pressure space existing within the main body. As a result, the flow of air including a great amount of toner into the toner hopper and scattering of toner outward are positively prevented thereby preventing considerable deterioration of the image quality or the like caused by the escape of toner outward.

Another developing device embodying the present invention comprises a toner hopper with its lid at the upper end of a main body thereof and a toner feed path for interconnecting the toner hopper with the main body, through which toner is fed into the main body from the toner hopper, said toner hopper comprising a guide member for guiding air which has come into the toner hopper from the main body through the toner feed path, in a direction so as to avoid a gap between the toner hopper and its lid.

The above guide member may be disposed, for instance, in the vicinity of a toner feed roller which is provided in proximity to the toner feed path within the toner hopper. Also, the guide member may be disposed in a raised condition close to the toner feed roller for instance, and may be designed to have a bending section at the upper part thereof so that air that has come into the toner hopper from the main body through the toner feed path can be guided toward the side wall portion of the toner hopper or toward the main body.

Further, the guide member may comprise a first guide member disposed in a raised condition in the vicinity of the toner feed roller which is positioned close to the toner feed path within the toner hopper, and a second guide member disposed depending from the side wall portion of the toner hopper in the extending direction of the first guide member.

In the developing device having the aforementioned arrangement, even if the air in the space in the vicinity of the toner feed path within the main body thereof is compressed by the heap of toner and the compressed air comes into the toner hopper by way of the toner feed path, the compressed air will be guided in a direction so as to avoid the gap between the toner hopper and its lid so that toner can be prevented from being blown off from the gap between the toner hopper and its lid by the flow of the compressed air. Consequently, the escape and scattering of toner through the gap can be prevented thereby preventing considerable deterioration of the image quality or the like which is generally caused by the scattering of toner.

DESCRIPTION OF THE EMBODIMENTS

Figure 1:
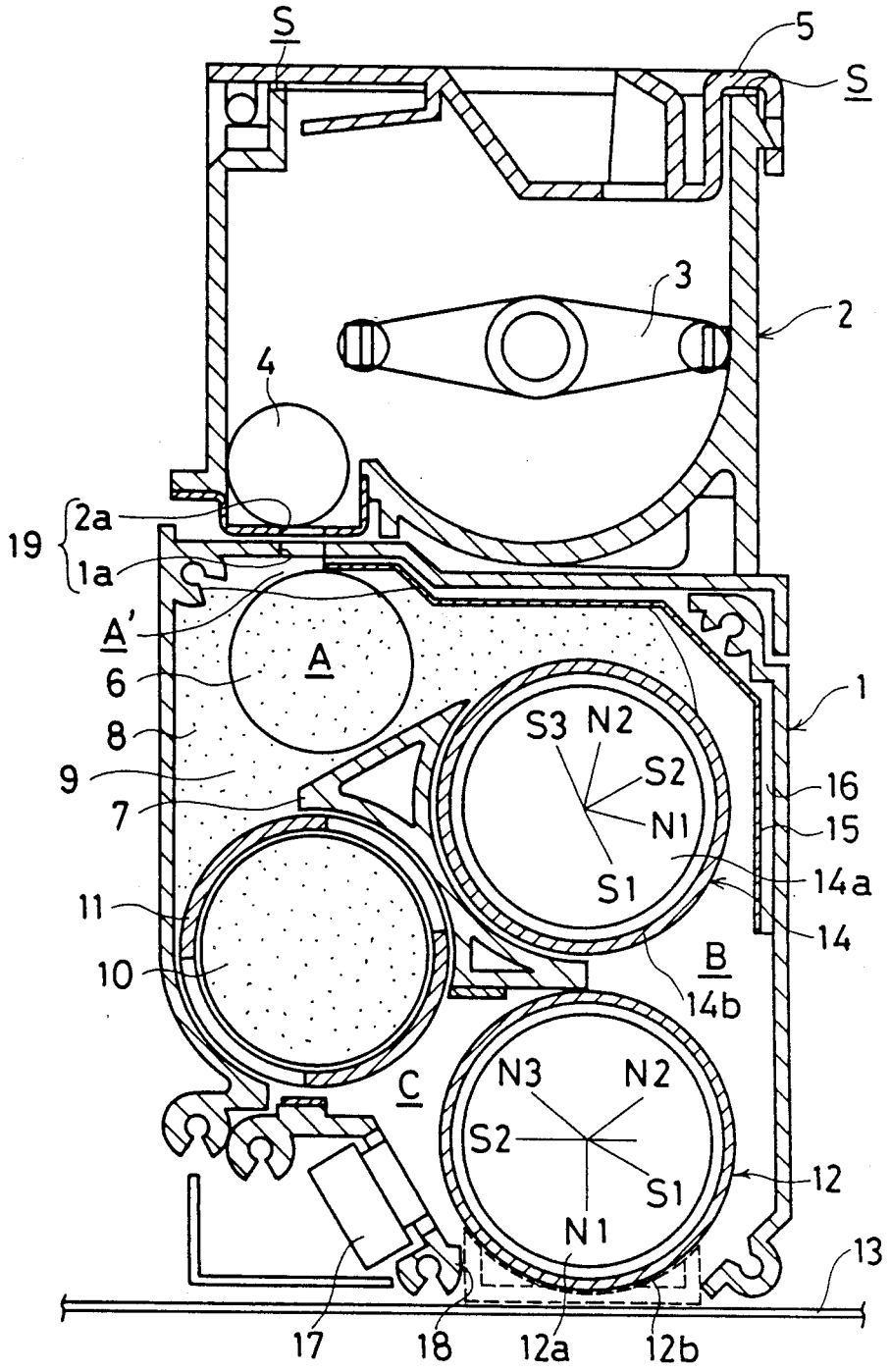
FIG. 1 is a longitudinal sectional view of the internal structure of a developing device according to an embodiment of the present invention, showing the condition thereof when no development is performed.

Referring now to FIG. 1, an embodiment of the present invention will be explained hereinbelow.

A developing device according to the present invention comprises a toner hopper 2 at the upper end of a main body 1 thereof as shown in FIG. 1. The toner hopper 2, including an agitating vane 3 rotatably disposed therein, is provided for the purpose of storing the toner particles of developer. At the bottom wall portion of the toner hopper 2 is formed an opening 2*a* through which toner stored in the toner hopper 2 is fed into the main body 1. Being close to the opening 2*a*, a toner feed roller 4 is rotatably disposed in the toner hopper 2. A lid 5 is disposed at another opening located at the upper end of the toner hopper 2 so as to cover the above opening.

The upper wall portion of the main body 1 has, at the position opposing to the opening 2*a*, an opening 1*a* for admitting the toner which has passed through the opening 2*a* into the main body 1. A toner feed path 19 is composed of the opening 1*a* and opening 2*a*.

The main body 1 of the developing device comprises a first agitating roller 6 rotatably diposed in the vicinity of the toner feed path 19, and a developer feed path 9 composed of a separator 7 and the side wall portion of the main body 1 under the first agitating roller 6. The developer feed path 9 comprises a second agitating roller 10 and a shutter mechanism 11 therein. The shutter mechanism 11, having the same center as that of the second agitating roller 10 is rotatably mounted around the peripheral side of the second agitating roller 10, and is designed such that its 90° turns allow the developer feed path 9 to be interconnected or shut off thereby switching from feeding developer 8 to a developing magnet roller 12 to suspending the above toner supply, or vice versa.

The developing magnet roller 12 comprising a magnet 12*a* and a rotative sleeve 12*b* which is rotatably mounted around the peripheral side of the magnet 12*a* so as to have the same center as that of the magnet 12*a*, is designed to continuously guide only toner particles onto a photoreceptor belt 13 while forming a magnet brush on the peripheral surface of the rotative sleeve 12*b* with the developer 8. Disposed between the shutter mechanism 11 and the developing magnet roller 12 are a toner density sensor 17 and doctor 18. Toner density detection is performed by the toner density sensor 17 and the amount of erected developer forming a magnetic brush is controlled by the doctor 18.

Disposed above the developing magnet roller 12 is a delivery magnet roller 14. The delivery magnet roller 14 comprising a magnet 14*a* and rotative sleeve 14*b* which is rotatably mounted around the peripheral side of the magnet 14*a* so as to have the same center as that of the magnet 14*a* is designed to receive the developer 8 which has been adhered to the rotative sleeve 12*b* of the developing magnet roller 12 and then guide it to the space A above the shutter mechanism 11. A path forming member 15 extends from the vicinity of the opening 1*a* formed at the upper wall portion of the main body 1 toward the vicinity of the lower part of the delivery magnet roller 14, passing along the upper wall portion and side wall portion of the main body 1.

The path forming member 15 is positioned a predetermined distance apart from the above wall portions of the main body 1. The above path forming member 15 and the upper and side wall portions of the main body 1 constitute an interconnecting path 16. The interconnecting path 16 interconnects the space A' formed in the vicinity of the toner feed path 19 within the main body 1 and the space B formed in the vicinity of the lower part of the delivery magnet roller 14. This interconnecting path 16 is provided such that the air in the space A' is not confined by the heap of developer 8.

In the above arrangement, the shutter mechanism 11 is open when development is performed, whereby the developer 8 which has been guided through the developer feed path 9 is formed into a magnetic brush on the peripheral surface of the rotative sleeve 12*b* of the developing magnet roller 12 and only toner particles are continuously fed onto the photoreceptor belt 13.

While no development is performed, the shutter mechanism 11 is closed as shown in FIG. 1, whereby the supply of the developer 8 to the developing magnet roller 12 is suspended. During the time when no development is performed, the rotative sleeve 12*b* of the developing magnet roller 12 and the rotative sleeve 14*b* of the delivery magnet roller 14 are continuously rotating. The developer 8 remaining at the space C between the shutter mechanism 11 and developing magnet roller 12 adheres to the peripheral surface of the rotative sleeve 12*b* accordingly by a N-pole N3 and S-pole S2 of the magnet 12*a* disposed in the developing magnet roller 12 and then reaches the vicinity of a N-pole N2 by way of a N-pole N1 and S-pole S1 as the rotative sleeve 12*b* rotates. At the time when the developer 8 has just passed through the N-pole N2, the magnetic force in the vicinity of the S-pole S1 of the magnet 14*a* disposed in the delivery magnet roller 14 is stronger than that of the magnet 12*a* disposed in the developing magnet roller 12, and the developer 8 is, therefore, delivered from the developing magnet roller 12 to the delivery magnet roller 14.

The developer 8 which has been delivered to the delivery magnet roller 14 is magnetically attracted by the S-pole S1 of the magnet 14*a* in the delivery magnet roller 14 and then adheres to the surface of the rotative sleeve 14*b*.

As the sleeve 14*b* rotates, the developer 8 passes through the N-pole N1, S-pole S2 and N-pole N2 of the magnet 14*a* and then reaches the S-pole S3 where the developer 8 is formed into a magnetic brush and scratched off by the separator 7. Being conveyed continuously to the space A above the shutter mechanism 11, the developer 8 gradually accumulates at the space A which extends from the shutter mechanism 11 to the delivery magnet roller 14.

As described above, as the developer 8 is continuously accumulating at the space A during the shutter mechanism 11 is closed, the heap of developer 8 formed above the delivery magnet roller 14 is uplifting. The air in the space A' in the vicinity of the toner feed path 19 within the main body 1, however, will not be confined by the developer 8 even if the heap of developer 8 reaches the upper wall portion of the main body 1, since there exists the interconnecting path 16 extending from the opening 1*a* of the main body 1 toward the vicinity of the lower part of the delivery magnet roller 14 along the wall portions of the main body 1. Therefore, even if the heap of develper 8 is pressed by the developer 8 which is being continuously conveyed, the air in the space A' will not be compressed but pushed out to the space B in the vicinity of the lower part of the delivery magnet roller 14 by way of the interconnecting path 16. The air in the space A' always flows into the space B where the air-pressure is relatively low, passing through the interconnecting path 16, because the toner hopper 2 has high resistance to the passage of air comparing with the interconnecting path 16 since large amounts of toner is stored in the toner hopper 2. To be more specific, the air within the space A' is released and then admitted in the different space B within the main body 1 of the developing device. In the use of the developing device having the above arrangement, the leakage of the air in the space A' into the toner hopper 2 can be prevented thereby positively preventing toner stored in the toner hopper 2 from flowing and scattering outward.

While there has been described a preferred embodiment wherein the space A' in the vicinity of the toner feed path 19 within the main body 1 of the developing device and the space B in the vicinity of the lower part of the delivery magnet roller 14 are interconnected, it should be understood that the outlet of the interconnected path 16 of the present invention does not necessarily face to the above space B. For example, the space C surrounded by the shutter mechanism 11 and developing magnet roller 12 may be interconnected with the space A' by the interconnecting path 16 the outlet of which faces to the space C. In the foregoing embodiment, the interconnecting path 16 composed of the wall portions of the main body 1 of the developing device and the path forming member 15 is disposed within the main body 1, but it is also possible to employ, for instance, an interconnecting path in the form of a pipe, disposed outside the main body 1 thereby interconnecting the space A' with the space B or the space C. That is, it does not matter whether the interconnecting path is disposed inside or outside the main body 1.

Figure 2:
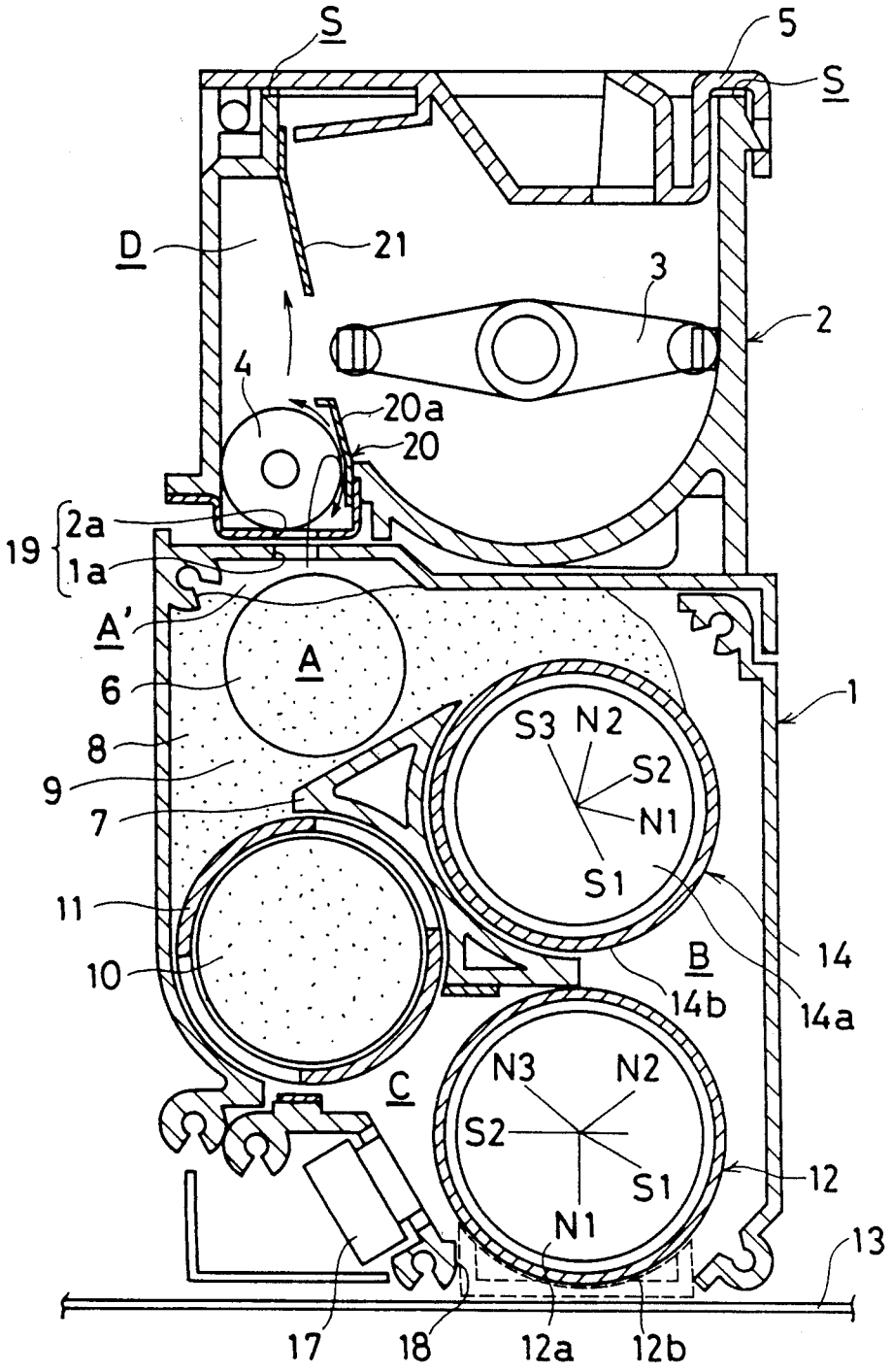
FIG. 2 is a longitudinal sectional view of the internal structure of a developing device according to another embodiment of the present invention, showing the condition thereof when no development is performed.
Figure 3:
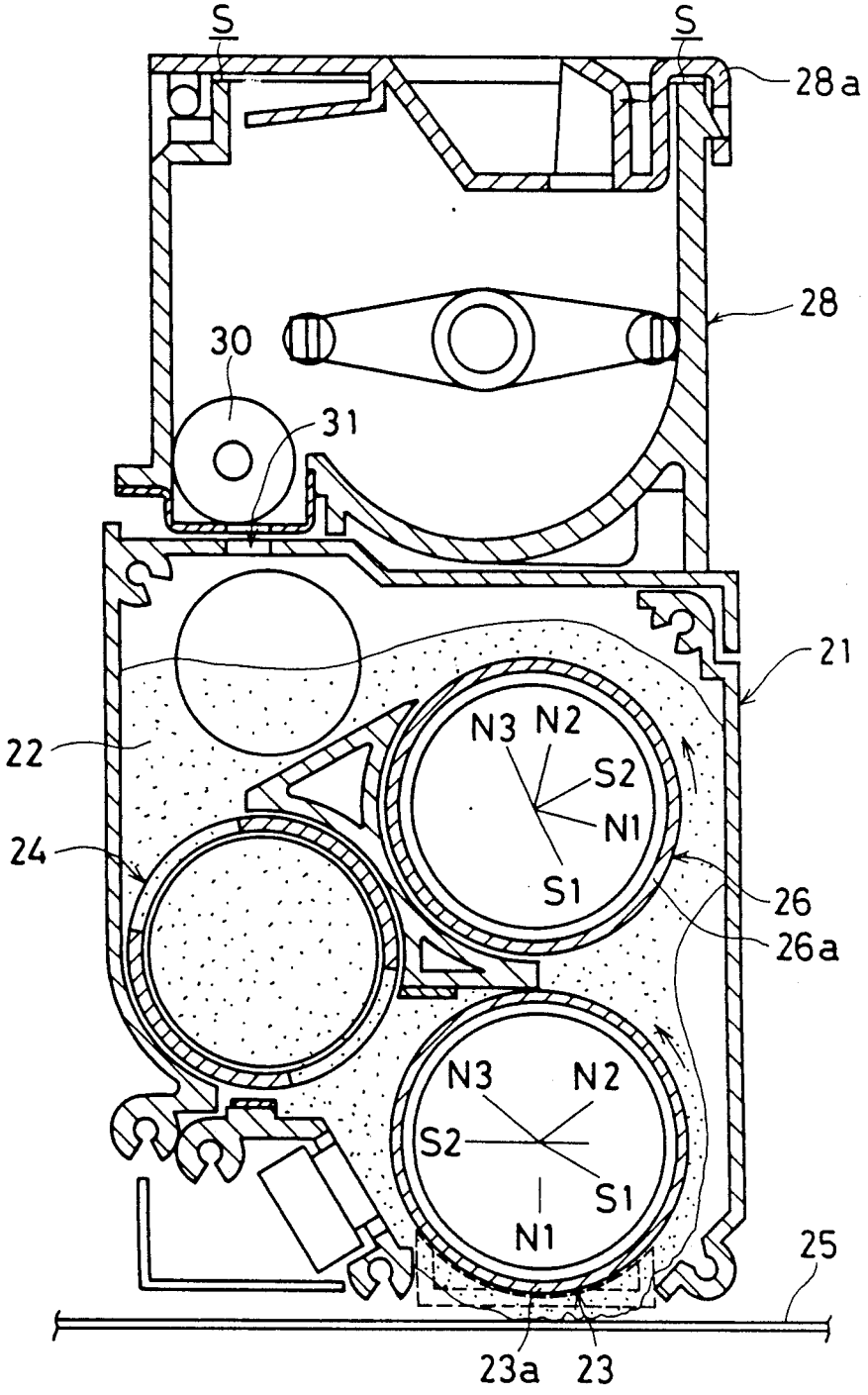
FIG. 3 is a longitudinal sectional view of the internal structure of a conventional developing device, showing the condition thereof when development is performed.
Figure 4:
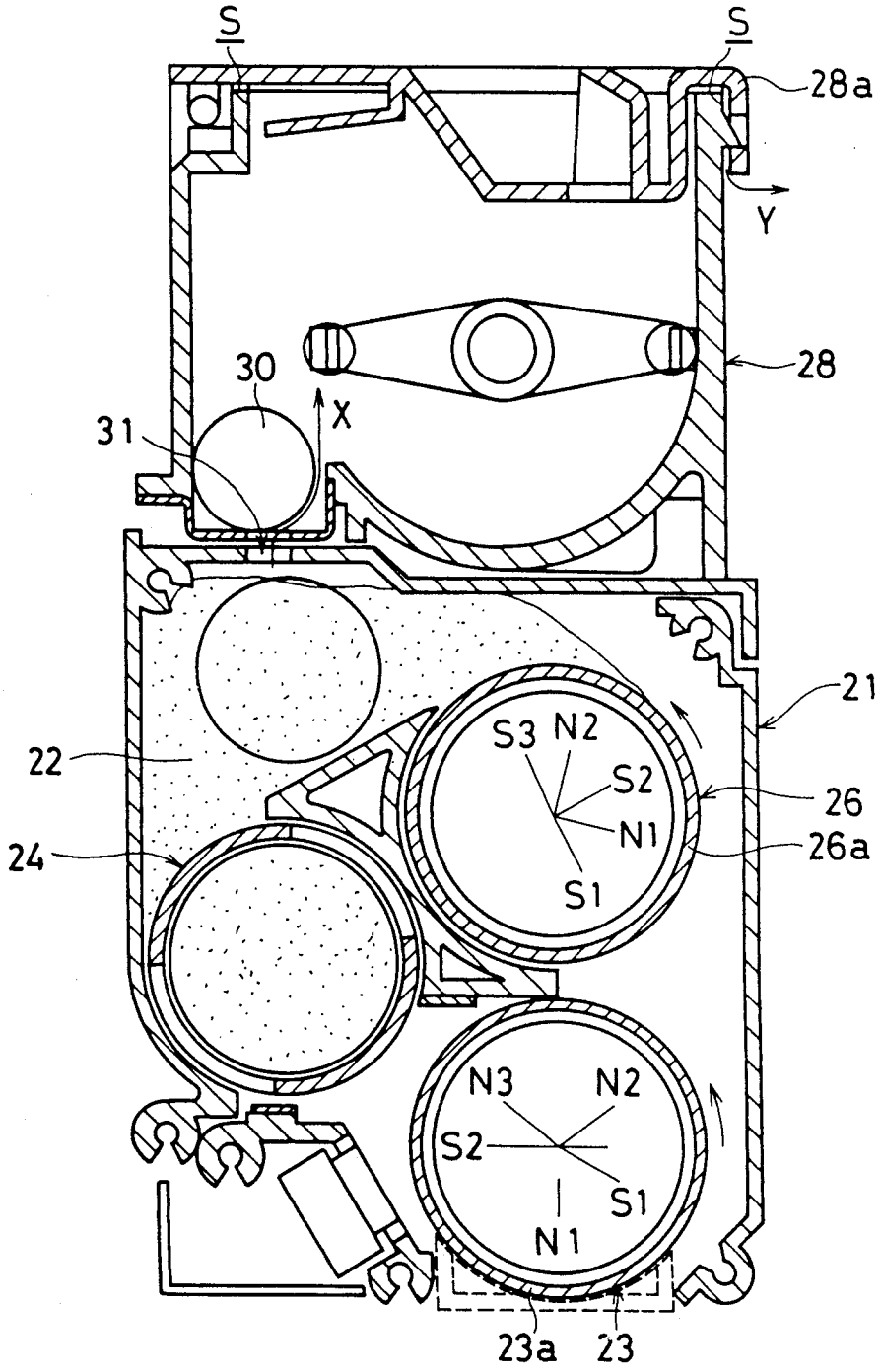
FIG. 4 is a longitudinal sectional view of the internal structure of the conventional developing device, showing the condition thereof when no development is performed.

Referring now to FIG. 2, another embodiment of the present invention will be explained. An explanation will be omitted regarding the components which are common with the above described embodiment.

In the toner hopper 2, a first guide member 20 is disposed over the peripheral surface of the toner feed roller 4, being opposing to the toner agitating vane 3 so as to guide air coming from the inside of the main body 1 of the developing device through the toner feed path 19, avoiding the gap S between the tonner hopper 2 and its lid 5. The first guide member 20 is installed in a raised condition in the vicinity of the toner feed roller 4 disposed in close proximity to the toner feed path 19 within the toner hopper 2. At the upper part of the first guide member 20 is formed a bending section 20*a* for guiding the air which has come into the toner hopper 2 through the toner feed path 19, toward the side wall portion of the toner hopper 2 or the main body 1 avoiding the gap S. The aforementioned first guide member 20 partially partitions the space to which the air coming through the toner feed path 19 goes up, and the gap S formed between the toner hopper 2 and its lid 5.

Above the first guide member 20 is disposed a second guide member 21 depending from the upper wall portion of the toner hopper 2 so as to partially partition the space to which the above air goes up and the gap S between the toner hopper 2 and its lid 5. The second guide member 21 located substantially in the extending direction of the first guide member 20 guides the remaining air which has not been guided by the first guide member 20 so that the air does not directly flow toward the gap S formed between the toner hopper 2 and its lid 5. Since the space D formed between the side wall portion of the toner hopper 2 which is partially hedged off and the second guide member 21 has no gap leading to the outside, the air guided by the first guide member 20 and the second guide member 21 temporarily stays at the space D and air including a great amount of toner, therefore, does not directly flow outward through the gap S between the toner hopper 2 and its lid 5.

The first guide member 20 and the second guide member 21 are positioned not so as to interfere with the motions of the toner agitating vane 3 and toner feed roller 4.

In the use of the developing device having the above arrangement, even if the air in the space A' in the vicinity of the toner feed path 19 within the main body 1 is compressed by the heap of developer 8 and the compressed air flows into the toner hopper 2 through the toner feed path 19, there is no likelihood that air including toner will directly flow and scatter outward through the gap S between the toner hopper 2 and its lid 5, because the air which has come into the toner hopper 2 through the toner feed path 19 is guided in a direction so as to avoid the gap S by means of the first guide member 20 and the second guide member 21, these guide members partially partitioning the space to which the air goes up, and gap S between the toner hopper 2 and its lid 5. More specifically, the air which has come into the toner hopper 2 through the toner feed path 19 is guided by the first guide member 20 toward the side wall portion of the toner hopper 2 or the main body 1 so as to avoid the gap S between the toner hopper 2 and its lid 5. Further, the remaining air which has not been guided by the first guide member 20 is guided to the space D where no gap leading to the outside exists, by means of the second guide member 21 positioned above the first guide member 20 and the air including toner temporarily stays at the space D. Consequently, the air including a great amount of toner is not blown off toward the gap S and therefore toner can be prevented from flowing and scattering outward through the gap S formed between the toner hopper 2 and its lid 5. Deterioration of the image density or the like which is generally caused by the scattering of toner outward thus can be prevented.

In case air comes into the toner hopper 2 from the inside of the main body 1, the air in the vicinity of the gap S between the toner hopper 2 and its lid 5 within the toner hopper 2 is pushed out through the gap S. This air, however, is relatively clean including little toner unlike the air which is blown up through the toner feed path 19, so that there is no likelihood that toner will flow outward through the gap S between the toner hopper 2 and its lid 5.

As described above, a developing device according to the present invention comprises, within a main body thereof, a developing magnet roller for feeding developer onto a photoreceptor; a shutter mechanism for switching from feeding developer to the developing magnet roller to suspending the above supply, or vice versa; and a delivery magnet roller for receiving developer from the developing magnet roller and conveying it to a path leading to the shutter mechanism, said developing device further comprising a toner feed path for interconnecting a toner hopper disposed at the upper end of the main body of the developing device and the space above the shutter mechanism; and an interconnecting path for interconnecting the space in the vicinity of the toner feed path within the main body and a different space, existing within the main body.

In the developing device of the above arrangement, even if the air in the vicinity of the toner feed path is compressed by the heap of developer which has been formed during the delivery of developer, the compressed air will not flow into the toner hopper through the toner feed path, but will be received in another space within the main body of the developing device. This enables to positively prevent the flow and scattering of toner outward which has adverse effect upon the quality of images produced by the copying apparatus or the like. While a developing device employing a method wherein compressed air is discharged outside the main body of the developing device and the toner contained in the above air is eliminated by a filter, requires periodic replacement of the filter or the like and replacement parts, the developing device of the present invention does not need such labour and replacement parts and therefore enables to save the maintenace cost.

Another developing device embodying the present invention comprises a toner hopper with its lid at the upper end of a main body thereof and a toner feed path for interconnecting the toner hopper with the main body, through which toner is fed into the main body from the toner hopper, said toner hopper comprising a guide member for guiding air which has come into the toner hopper from the main body through the toner feed path, in a direction so as to avoid a gap between the toner hopper and its lid.

In the developing device of the above arrangement, even if the air in the space in the vicinity of the toner feed path is compressed by a heap of developer and the compressed air comes into the toner hopper through the toner feed path, the compressed air will be guided so as to avoid the gap formed between the toner hopper and its lid, thus preventing the compressed air from blowing toner stored in the toner hopper outward through the above gap. This enables to prevent considerable deterioration of the image quality of the copying apparatus or the like, which is generally caused by the flow of toner outward.

What is claimed is:

1. A developing device comprising:

A. a developing magnet roller for feeding developer onto a photoreceptor;

B. a shutter mechanism for switching from feeding developer to the developing magnet roller to suspending the above feed of developer, or vice versa;

C. a delivery magnet roller for receiving developer from the developing magnet roller and conveying it to a path leading to the shutter mechanism;

D. a toner feed path for interconnecting a toner hopper disposed at the upper end of a main body of the developing device and the space above the shutter mechanism; and E. an interconnecting path for interconnecting the space in the vicinity of the toner feed path within the main body and a different space existing within the main body.

2. A developing device according to claim 1 wherein said interconnecting path is disposed inside the main body so as to interconnect the space in the vicinity of the toner feed path and the different space.

3. A developing device according to claim 1 wherein said interconnecting path is disposed outside the main body in the form of a pipe so as to interconnect the space in the vicinity of the toner feed path and the different space.

4. A developing device according to claim 1 wherein said different space, existing within the main body, which is to be interconnected with the space in the vicinity of the toner feed path is the space in the vicinity of the lower part of the delivery magnet roller disposed above the developing magnet roller.

5. A developing device according to claim 1 wherein said different space, existing within the main body, which is to be interconnected with the space in the vicinity of the toner feed path is the space surrounded by the shutter mechanism and the developing magnet roller.

6. A developing device according to claim 1 wherein said interconnecting path is formed by the wall portions of the main body, and a path forming member disposed along the wall portions leaving a predetermined spacing therebetween.

7. A developing device comprising:

A. a toner hopper with its lid disposed at the upper end of a main body thereof; and B. a toner feed path for interconnecting the toner hopper with the main body, through which toner is fed into the main body from the toner hopper, said toner hopper including a guide member for guiding air which has come into the toner hopper from the main body through the toner feed path so as to avoid a gap between the toner hopper and the lid.

8. A developing device according to claim 7 wherein said guide member is disposed in the vicinity of a toner feed roller disposed in proximity to the toner feed path within the toner hopper.

9. A developing device according to claim 7 wherein said guide member is disposed in a raised condition in the vicinity of the toner feed roller disposed in proximity to the toner feed path within the toner hopper.

10. A developing device according to claim 9 wherein said guide member comprises a bending section at the upper part thereof so that air that has come into the toner hopper from the main body through the toner feed path can be guided toward the side wall portion of the toner hopper or toward the main body.

11. A developing device according to claim 7 wherein said guide member comprises a first guide member disposed in a raised condition in the vicinity of the toner feed roller which is disposed in proximity of the toner feed path within the toner hopper, and a second guide member disposed depending from the side wall portion of the toner hopper in the extending direction of the first guide member.

* * * * *